United States Patent [19]

Coffinberry

[11] 4,096,616

[45] Jun. 27, 1978

[54] METHOD OF MANUFACTURING A CONCENTRIC TUBE HEAT EXCHANGER

[75] Inventor: George A. Coffinberry, Cincinnati, Ohio

[73] Assignee: General Electric Company, Cincinnati, Ohio

[21] Appl. No.: 736,571

[22] Filed: Oct. 28, 1976

[51] Int. Cl.[2] ..... B23P 15/26

[52] U.S. Cl. ..... 29/157.3 A; 165/182; 165/141; 165/154

[58] Field of Search ..... 29/157.3 R, 157.3 A, 29/157.3 C, 157.3 D, 157.3 B; 165/182

[56] References Cited

U.S. PATENT DOCUMENTS

| | | | |
|---|---|---|---|
| 2,693,026 | 11/1954 | Simpelaar | 29/157.3 A |
| 2,703,921 | 3/1955 | Brown, Jr. | 29/157.3 A |
| 3,158,122 | 11/1964 | DeGive | 29/157.3 A |
| 3,636,607 | 1/1972 | DeMarco | 29/157.3 R |

*Primary Examiner*—C.W. Lanham
*Assistant Examiner*—V. K. Rising
*Attorney, Agent, or Firm*—Henry J. Policinski; Derek P. Lawrence

[57] ABSTRACT

A method is provided for manufacturing a concentric-tube heat exchanger which includes at least a pair of concentric tubes disposed one within the other to form an annular longitudinally extending flow channel in which a plurality of heat transfer promoting fins reside. The method includes the step of applying a radially directed force to one of the pair of concentric tubes in sufficient magnitude to permanently deform the tube into engagement with the plurality of heat transfer promoting fins.

13 Claims, 5 Drawing Figures

METHOD OF MANUFACTURING A CONCENTRIC TUBE HEAT EXCHANGER

BACKGROUND OF THE INVENTION

This invention relates to a method of fabricating a heat exchanger arrangement for transferring thermal energy between one fluid and another and, more particularly, to a heat exchanger well adapted for use in exchanging thermal energy between the fuel and oil systems associated with an aircraft gas turbine engine.

In gas turbine engine technology it is well known that engine fuel may be used to cool the engine oil used for lubrication. Typically, the thermal energy released from the engine oil during cooling is absorbed by the fuel about to be burned in the engine combustor and the cooled oil is better adapted to lubricate the rotating elements of the engine. Prior art fuel-oil heat exchangers have included designs wherein several hundred small diameter, thin-walled hollow tubes, each carrying fuel are arranged in parallel fashion with respect to the flow of fuel through the tubes. Engine oil is passed over the external surfaces of the tubes whereby thermal energy is exchanged between the engine fuel and the engine oil. Each hollow tube is brazed or attached by mechanical means at its ends to inlet and outlet headers.

Manufacture of the heat exchangers of the type just described has proved to be highly expensive for a number of reasons. By way of example, handling, fixturing and other operations associated with assembly of the heat exchanger are numerous as a consequence of the large number of component parts. Additionally, inspection, testing and other quality control measures must be exhaustively applied to ensure the integrity of the numerous brazed or mechanical joints associated with the above-mentioned tubes and headers. The high manufacturing costs associated with prior art heat exchangers demand new and improved heat exchanger designs. One type of heat exchanger design, known as a concentric-tube type, may be considered to have particular application to fuel-oil heat exchange in a gas turbine engine. The concentric-tube heat exchanger is generally comprised of concentric tubular members of different diameter disposed coaxially, one within the other, to form an annular flow channel into which a plurality of heat transfer promoting fins are disposed. One fluid flows in a first annular channel formed between a first pair of tubes while a second fluid flows through a second annular flow channel formed between a second pair of tubes. The exchange of heat between the fluids is accomplished by conduction of heat through the fins and the cylindrical tubes. With concentric-tube heat exchangers it is important to provide substantial surface contact between the heat transfer promoting fins and the cylindrical tubes so that an optimum heat conduction path is established. The invention, hereinafter described, is directed toward a method of fabricating a heat exchanger of the above-mentioned concentric-tube type wherein the method provides an optimal heat conduction path.

SUMMARY OF THE INVENTION

It is therefore an object of the present invention to provide a method of fabricating a heat exchanger of the concentric-tube type wherein such fabrication is accomplished in an efficient and economical manner and provides for substantial surface contact between the heat transfer promoting fins and the cylindrical tubes whereby improved heat transfer may be accomplished.

Briefly stated, the above and other objects of the present invention which will become apparent from the following specification and appended drawings, are accomplished by the present invention which, in one form, provides a method for use in fabricating a heat exchanger adapted to transfer heat between first and second fluids and including at least a pair of longitudinally extending concentric tubes, one of the tubes being disposed in the other of the tubes to form an annular flow channel therebetween in which a plurality of heat transfer promoting fins reside. The method includes applying a radially directed deforming force to the pair of tubes in sufficient magnitude to achieve permanent deformation. The deforming force may be applied to the outer tube in the radially inwardly or to the inner tube radially outwardly direction. The method may further include a subsequent brazing step for brazing the plurality of fins to the pair of concentric tubes.

DESCRIPTION OF THE DRAWINGS

While the specification concludes with a series of claims which particularly point out and distinctly claim the subject matter comprising the present invention, a clear understanding of the invention will be obtained from the following detailed description which is given in connection with the accompanying drawings, in which:

DESCRIPTION OF THE PREFERRED EMBODIMENT

Figures 1, 2, 3:
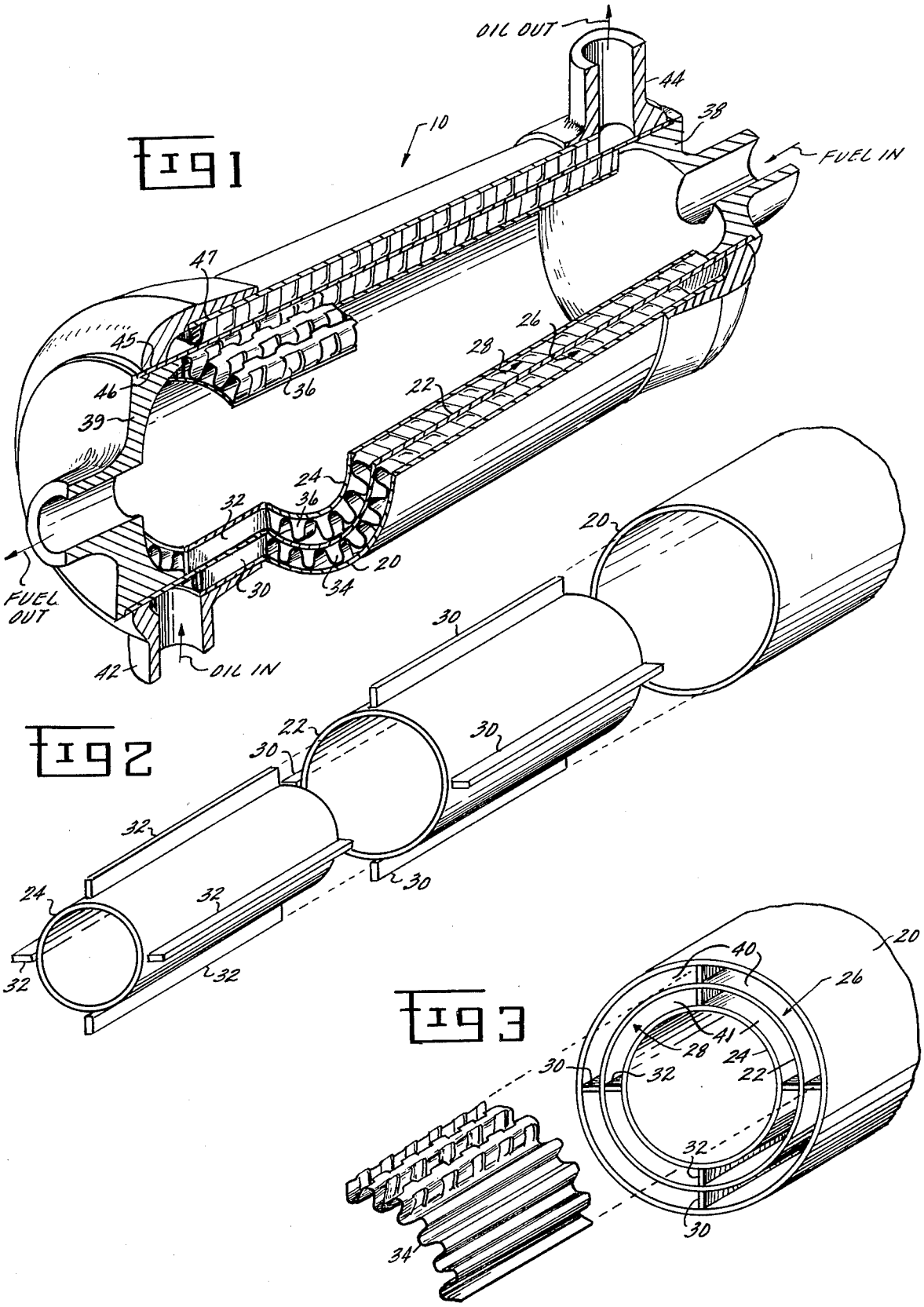
FIG. 1 depicts a concentric-tube heat exchanger in a perspective cutaway view.
FIG. 2 depicts an exploded view of a portion of the heat exchanger shown in FIG. 1.
FIG. 3 depicts an exploded view of a portion of the heat exchanger shown in FIG. 1.

Referring now to FIG. 1, a heat exchanger, shown generally at 10, of the concentric-tube type is depicted in a perspective cutaway view. First, second and third axially or longitudinally extending, cylindrical wall members or tubes 20, 22 and 24, respectively, are disposed concentrically, one within the other, in a radially spaced relationship. The radial spacing between tubes 20 and 22 forms a first longitudinally extending annular flow channel 26 while the radial spacing between tubes 22 and 24 forms a second longitudinally extending annular flow channel 28. The radial spacing between tubes 20 and 22 and tubes 22 and 24 is maintained by first and second pluralities of longitudinally extending spacer members 30 and 32, respectively. Spacer members 30 are positioned circumferentially spaced apart within annular flow channel 26 while spacer members 32 are disposed circumferentially spaced apart within annular flow channel 28.

A first plurality of heat transfer promoting fins 34 reside in annular flow channel 26 in heat transferring engagement with tube 22 while a second plurality of heat transfer promoting fins 36 reside in annular flow channel 28 in heat transferring engagement with tube 22. Annular flow channels 26 and 28 are adapted to pass separate first and second fluids respectively therethrough. Heat transfer between the first and second fluids is accomplished via a heat transfer path comprised of heat transfer promoting fins 34, tube 22 and heat transfer promoting fins 36. By way of example, if a first fluid, such as oil, is made to flow through annular channel 26 in the longitudinal or axial direction and if a cooler second fluid, such as fuel, is made to flow through annular channel 28 in the longitudinal direction heat will be transferred in the radial direction from the oil to heat transfer promoting fins 34 thence to tube 22 thence to heat transfer promoting fins 36 and thence to the fuel flowing in channel 28.

Fuel inlet and outlet headers 38 and 40 are adapted to provide inlet and outlet means respectively for admitting and discharging fuel from opposite ends of annular flow channel 28. Oil inlet and outlet headers 42 and 44 similarly provide inlet and outlet means respectively for admitting and discharging oil from opposite ends of annular flow channel 26.

Figure 4:
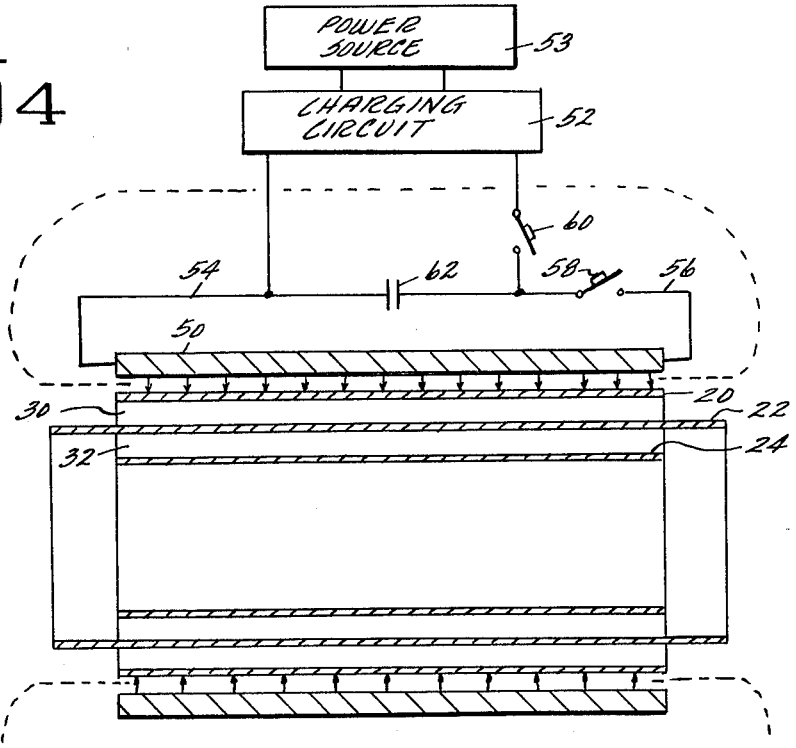
FIG. 4 is a schematic view depicting one manufacturing step of the present invention.

The method of fabricating the concentric-tube heat exchanger depicted in FIG. 1 will now be described with reference to FIGS. 2, 3, and 4. As depicted in FIG. 2, tube 22 is inserted into tube 20 in a first radially spaced relationship therewith so as to form an annular flow channel 26 between tubes 20 and 22 into which the first plurality of spacer members 30 are inserted. After insertion of spacer members 30 into annular flow channel 26, tube 24 is inserted into tube 22 and disposed so as to form an annular flow channel 28 between tubes 22 and 24 into which the second plurality of spacer members 32 are inserted. Spacer members 30 and 32 are disposed at circumferentially spaced apart locations to form first and second pluralities of flow segments 40 and 42, respectively. The first plurality of heat transfer promoting fins 34 are then inserted into flow segments 40 and the second plurality of heat transfer promoting fins 36 are inserted into flow segments 42. Heat transfer promoting fins 34 and 36 are generally of a corregated configuration and may be formed by a stamping operation utilizing thin sheet stock and appropriately configured stamping dies.

In order to retain the spacer members 30 and 32 and heat transfer fins 34 and 36 securely disposed within the annular flow channels 26 and 28, the entire assembly core comprised of tubes 20, 22, 24, spacer members 30, 32 and heat transfer promoting fins 34, 36 is permanently deformed by application of a deformation force in the radial direction. Radial deformation further enhances the surface contact between the heat transfer promoting fins 34, 36 and their respective tubes 20, 22 and 24. The enhanced surface contact, achieved by radial deformation, provides an optimal heat conduction path for the transfer of heat between the tubes and fins.

Prior to deformation spacer members 30, 32 and fins 34, 36 reside in their respective annular flow channels 26, 28 in a loose fit condition wherein small clearances exist between spacer members 30, 32 and the surfaces of tubes 20, 22, 24. Similarly, fins 34, 36 are disposed at a small clearance distance from the surfaces 20, 22, 24. These clearances are provided to assist easy assembly of spacer members 30, 32 and fins 34, 36 into their respective annular flow channels 26, 28. The clearance between the fins 34, 36 and the surface of tubes 20, 22, 24 is generally less than the clearance between the spacer members 30, 32 and the surfaces of tubes 20, 22, 24.

Deformation of the assembly core may be accomplished by applying a substantially uniform radially inwardly directed compressive force to the external cylindrical surface of tube 20. A particularly effective approach to achieving application of a substantially uniform force to a cylindrical member is known as magnetic pulse forming. More particularly, deformation may be achieved by disposing the heat exchanger assembly within an intense transient magnetic field as viewed in FIG. 4. The heat exchanger assembly core shown inserted into a cavity encircled by a cylindrical compression coil 50 electrically connected to a charging circuit 52, which is in turn connected to power source 53 via electrical conductors 54, 56. A pair of switches 58, 60 serve to provide means for selectively actuating the compression coil 50. Capacitor 62 is connected between electrical conductors 54, 56 and serves to cause compression coil 50 to generate a variable transient magnetic field between the compression coil 50 and the outer surface of tube 20 of the heat exchanger assembly core. The transient magnetic field asserts a radially inwardly directed transient magnetic pressure force (as indicated by the arrows in FIG. 4) uniformly over the outer surface of tube 20. The magnetic pressure force cannot be maintained for a long period of time since the magnetic field leaks through the metal cylinder at a rate determined by the sensitivity of the metal utilized in the heat exchanger, so that finally the external field pressure and the net force on the heat exchanger is zero. However, by applying successive magnetic field pressures of very short duration, 10 to 100 micro seconds by way of example, substantial external field pressure may be maintained with a negligible internal field pressure. In this manner, then the heat exchanger may be compressed and permanently deformed for purposes hereinbefore described. Magnetic pulse forming has been utilized in the art for a number of years, and hence the particular operating parameters and design criteria for magnetic pulse forming apparatus suitable for the present application are known to or could be readily determined by those skilled in the art.

During compression of the assembly core the aforementioned clearances are eliminated. Initial compression eliminates the clearance between the fins 34 whereupon the fins 34 abuttingly engage the inner surface of tube 20 and the outer surface of tube 22. Additional compression of the assembly core effects abutting engagement between spacer members 30 and the inner surface of tube 20 and the outer surface of tube 22. Application of further compressive force causes tube 22 to deform radially inwardly such that the inner surface of tube 22 engages fins 36 which in turn further engage the outer cylindrical surface of tube 24. Finally the compressive force causes spacer members 32 to engage inner surface of tube 22 and the outer surface of tube 24. Spacer members 30 and 32 serve as rigid struts to establish a predetermined spacing between tubes 20 and 22 and between tubes 22 and 24, respectively. The spacing is carefully selected to ensure the desired contact or engagement between fins 34, 36 and their respective tubes 20, 22 and 24 necessary to effect an efficient and secure braze therebetween during a subsequent brazing operation. Upon achieving abutting engagement between spacer members 30, 32 and tubes 20, 22 and 24 as hereinbefore described, further compression of the assembly is terminated. The permanent deformation induced by application of compressive forces ensures that spacer members 30, 32 and fins 34, 36 are fixedly secured within and in abutting contact with their respective tubes 20, 22 and 24. With the core assembly deformed, the heat transfer promoting fins 34 and 36 are in substantial surface contact with their respective tubes 20, 22 and 24. Substantial surface contact provides an optimal heat conduction path for the transfer of heat.

Alternative methods for permanently deforming the core assembly will now be described with reference to FIG. 5. The heat exchanger core assembly is depicted disposed within a cylindrical longitudinally extending backing plate 70 which may be split lengthwise to facilitate disposition of plate 70 around the core assembly. Deformation of the core assembly is accomplished by passing a mandrel 72, having an enlarged head 74 through the interior of tube 24. Mandrel head 74 is provided with a diameter slightly larger than the internal diameter of tube 24. Passage of head 74 through tube 24 causes tube 24 to expand radially to an enlarged diameter such that the outer surface of tube 24 engages spacer members 32 which, acting as rigid struts between tubes 24 and 22, cause expansion of center tube 24. Similarly, center tube 24 is caused by the spacer members 32 to expand radially outward into engagement with spacer members 30 which act as rigid struts between tubes 22 and 20. The aforementioned deformation also causes fins 36 to engage the inner surface of tube 22 and the outer surface of tube 24 and the fins 36 to engage the outer surface of tube 22 and the inner surface of tube 20. This engagement provides an optimal heat conduction path and hence enhances heat transfer between the tubes and the fins.

Figure 5:
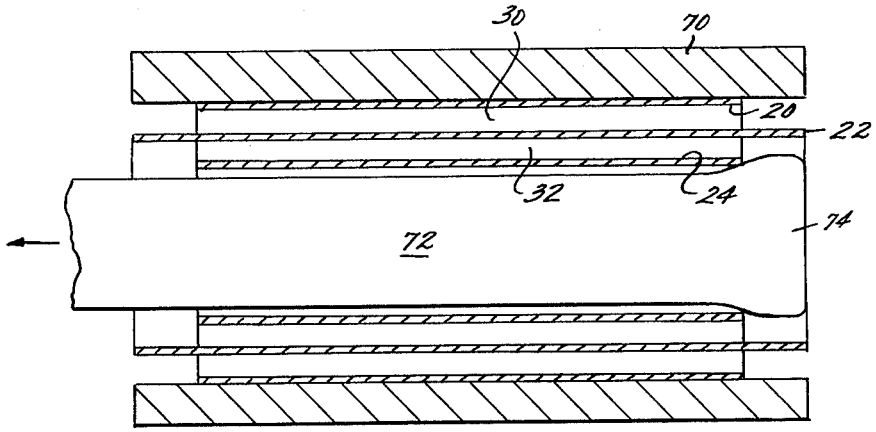
FIG. 5 depicts an alternative step for manufacturing the heat exchanger.

A variation of the method depicted in FIG. 5 may be accomplished by disposing backing plate within the inner tube 22 and passing the core assembly through die having an aperture with a diameter slightly less than the outer diameter of outer tube 20. With such variation, a radially inward compressive force is exerted on the core assembly and radially inward compression and deformation is accomplished.

After forming the assembly core, headers 38, 40, 42 and 44 are then positioned at the ends of the core with braze foil 45, 46, 47 inserted in clearance spaces (not shown) between the tubes and headers. The heat exchanger 10 is then subjected to a fluxless braze process wherein the fins 34, 36 and spacers 30, 32, which have been preclad with a brazing alloy prior to stamping, are simultaneously brazed to tubes 20, 22 and 24. Tubes 20, 22, 24 may also be preclad with braze alloy if found necessary. More specifically, simultaneous brazing is effected between fins 34 and tubes 20, 22, between fins 36 and tube 22, between fuel inlet and outlet headers 38, 40 and tube 22 and between oil inlet and outlet headers 42, 44 and tubes 20, 22. Simultaneous brazing permits the brazing operation to be accomplished with a minimum amount of time and without the subsequent cleaning and stripping of excess brazing flux from the completed assembly associated with the more conventional dip braze process techniques.

From a reading of the foregoing specification, it will be appreciated that the application of deformation forces, to enhance the surface contact between the fins and the cylindrical tubes, followed by subsequent fluxless brazing ensures uniform and continuous heat transfer conduction path for the transfer of heat between fuel and oil passages 28 and 26 respectively during engine operation. Additionally, the brazed connection between spacer members 30, 32 and fins 34, 36 and their respective tubes 20, 22, 24 serves to reduce expansion of tubes 20, 22, 24 due to fluid pressure induced expansive forces. More specifically, spacer members 30, 32 and fins 34, 36 act as tension members for restraining radially outward expansion of tubes 20, 22, 24 under operating conditions.

While the preferred embodiment of my invention has been fully described, it is understood that modifications of the method may be made within the spirit of my invention and that it is not to be regarded as being limited to the exact details of the description, but may be utilized without departing from the scope of the invention as defined by the following claims wherein

I claim:

1. A method for use in fabricating a heat exchanger adapted to transfer heat between first and second fluids, said heat exchanger comprised of at least a pair of longitudinally extending concentric tubes, one of said tubes disposed within the other to form a longitudinally extending annular flow channel therebetween and plurality of heat transfer promoting fins disposed within said annular flow channel, said method comprising the steps of:

disposing one of said tubes within the other of said tubes to form a first longitudinally extending channel therebetween;

inserting a plurality of spacer members into said flow channel at circumferentially spaced apart locations so as to form a plurality of longitudinally extending flow segments between said plurality of spacer members;

positioning a plurality of heat transfer promoting fins within said plurality of flow segments; and applying a radially directed deforming force to said pair of tubes in sufficient magnitude to achieve permanent deformation of said pair of tubes to retain said spacing members and said heat transfer promotion fins securely disposed within said annular flow channel.

2. The invention as set forth in claim 1 wherein said deforming force is applied to said one of said tubes in a radially outward direction in sufficient magnitude to permanently expand said one of said tubes.

3. The invention as set forth in claim 1 wherein said deforming force is applied to said other of said tubes in a radially inward direction in sufficient magnitude to permanently deform said other of said tubes radially inwardly.

4. The invention as set forth in claim 1 further comprising the step of brazing said plurality of fins to said pair of concentric tubes.

5. A method for use in fabricating a heat exchanger adapted to transfer heat between first and second fluids, said heat exchanger including a first longitudinally extending cylindrical wall member, a second longitudinally extending cylindrical wall member disposed within said first cylindrical wall member to form therebetween a first longitudinally extending annular flow channel, a third longitudinally extending cylindrical wall member disposed within said second wall member to form therebetween a second longitudinally extending annular flow channel, first and second pluralities of radially extending heat transfer promoting fins disposed within said first and second annular flow channels respectively, first and second pluralities of longitudinally extending spacer members disposed within said first and second flow channel respectively, a pair of fluid inlet and outlet headers disposed at spaced apart ends of said heat exchanger, said method comprising the steps of :

disposing said second cylindrical member within said first cylindrical member to form said first longitudinally extending flow channel therebetween;

inserting said first plurality of spacer members into said first flow channel at circumferentially spaced apart locations so as to form a first plurality of longitudinally extending flow segments between said first plurality of spacer members;

positioning said first plurality of radially extending heat transfer promoting fins within said first plurality of flow segments; and applying a radially directed deformation force to one of said first and second cylindrical wall members, said force applied in sufficient magnitude to permanently deform said one of said members into abutting surface contact with said first plurality of heat transfer promoting fins and said first plurality of spacer members.

6. The invention as set forth in claim 5 wherein said step of applying said deformation force further includes the step of applying a magnetic pressure force generated by a transient magnetic field.

7. The method as set forth in claim 5 further including the step of:

brazing said first plurality of fins to at least one of said first and second cylindrical wall members.

8. The method as set forth in claim 5 wherein said deformation force is applied to said first wall member in a radially inward direction.

9. The method as set forth in claim 5 wherein said deformation force is applied to said second wall member in a radially outward direction.

10. The method as set forth in claim 5 further including the steps of:

disposing fluid inlet and outlet headers at the longitudinal ends of said heat exchanger; and brazing said first plurality of fins to one of said first and second cylindrical wall members simultaneous with brazing of said inlet and outlet headers to at least one of said first and second cylindrical wall members.

11. The method as set forth in claim 5 further including the steps of:

disposing said third cylindrical member within said second cylindrical member to form said second longitudinally extending annular flow channel therebetween;

inserting said second plurality of spacer members into said second flow channel at circumferentially spaced apart locations so as to form a second plurality of longitudinally extending flow segments between said second plurality of spacer members;

positioning said second plurality of radially extending heat transfer promoting fins within said second plurality of flow segments; and applying said radially directed compressive force in sufficient magnitude to permanently deform said second wall member into abutting surface contact with said second plurality of fins and with said second plurality of spacer members.

12. The invention as set forth in claim 11 further including the step of:

brazing said first plurality of fins to said second wall member simultaneously with brazing of said second plurality of fins to said second wall member.

13. The invention as set forth in claim 12 further comprising the steps of:

disposing fluid inlet and outlet headers at the longitudinal ends of said heat exchanger; and brazing said fluid headers to one of said first and second wall members simultaneously with said brazing of said first and second plurality of fins.

* * * * *